US006273694B1

(12) United States Patent
Vading

(10) Patent No.: US 6,273,694 B1
(45) Date of Patent: Aug. 14, 2001

(54) ROTARY-PISTON MACHINE

(75) Inventor: Kjell Vading, Bodo (NO)

(73) Assignee: Vading Motor AS, Bodo (NO)

( * ) Notice: Subject to any disclaimer, the term of this patent is extended or adjusted under 35 U.S.C. 154(b) by 0 days.

(21) Appl. No.: 09/622,980

(22) PCT Filed: Feb. 19, 1999

(86) PCT No.: PCT/NO99/00060

§ 371 Date: Aug. 25, 2000

§ 102(e) Date: Aug. 25, 2000

(87) PCT Pub. No.: WO99/43926

PCT Pub. Date: Sep. 2, 1999

(30) Foreign Application Priority Data

Feb. 25, 1998 (NO) ..... 19980783
Jan. 26, 1999 (NO) ..... 19990364

(51) Int. Cl.[7] ..... F03C 2/00

(52) U.S. Cl. ..... 418/137; 418/13; 418/136; 418/140; 418/145; 418/147; 418/241

(58) Field of Search ..... 418/137, 140, 418/145, 136, 147, 241, 13

(56) References Cited

U.S. PATENT DOCUMENTS

| | | | | |
|---|---|---|---|---|
| 1,138,481 | * | 5/1915 | Hupe | 418/215 |
| 1,550,835 | * | 8/1925 | Morgan | 418/136 |
| 1,661,593 | | 3/1928 | Bodker . | |
| 2,382,259 | * | 8/1945 | Rohr | 418/137 |
| 3,356,292 | * | 12/1967 | Brewer et al. | 418/137 |
| 3,419,208 | * | 12/1968 | Bewer et al. | 418/137 |
| 3,457,872 | * | 7/1969 | Potts | 418/137 |
| 3,537,432 | | 11/1970 | Jordaan . | |
| 3,747,573 | | 7/1973 | Foster . | |
| 4,011,033 | * | 3/1977 | Christy | 418/253 |
| 4,061,450 | | 12/1977 | Christy . | |
| 4,389,173 | * | 6/1983 | Kite | 418/146 |
| 5,709,188 | * | 1/1998 | Al-Qutub | 418/260 |
| 6,036,462 | * | 3/2000 | Mallen | 418/150 |
| 6,120,273 | * | 9/2000 | Mallen | 418/255 |

FOREIGN PATENT DOCUMENTS

| | | | | |
|---|---|---|---|---|
| 143932-A | * | 1/1951 | (AU) | 418/137 |
| 02-275081-A | * | 11/1990 | (JP) | 418/262 |

* cited by examiner

*Primary Examiner*—Thomas Denion
*Assistant Examiner*—Theresa Trieu
(74) *Attorney, Agent, or Firm*—Young & Thompson

(57) ABSTRACT

A rotary-piston machine (10) comprising a housing (5) having a cavity (9), a rotor (2) received in the housing (5), which rotor (2) having a rotor axis (A) and a peripheral surface (21), inlet and outlet passages (3, 4) in communication with said cavity (9), one or more vanes (1) radially slideable received in slots (11) in the rotor (2), each vane (1) extending radially from the internal surface (20) of the housing (5) to the rotor axis (A), and at least one working chamber (9*a*) being part of the cavity (9) and is defined by the internal surface (20) of the housing (5), the peripheral surface (21) of the rotor (2) and the side surface of at least one vane (1). Each vane (1) is articulated connected about an axis (C) to one end of a control arm (7) and is in the other end pivotable journalled in a fixed axle shaft (8) having a central axis (B) being coincident with the axis extending centrally through the cavity (9) of the housing (5), which axis (B) extend in parallel with and spaced (d) from the rotor axis (A), and the rotor (2) proper constitute the unit for power take off or power input.

9 Claims, 11 Drawing Sheets

ROTARY-PISTON MACHINE

BACKGROUND OF THE INVENTION

The present invention relates to a rotary-piston machine comprising a housing having a cavity, a rotor received in the housing, which rotor has a rotor axis and a peripheral surface, inlet and outlet passages in communication with said cavity, one or more vanes radially slideable received in slots in the rotor, each vane extending radially from the internal surface of the housing to the rotor axis, and at least one working chamber being part of the cavity and is defined by the internal surface of the housing, the peripheral surface of the rotor and the side surface of at least one vane.

The rotary-piston machine is a thermodynamic machine, which by some modifications can be utilised as combustion engine, heat exchanger, punip, vacuum pump and compressor. The rotary machine can be assembled in several units and in series so that the machine principle is used both for the compressor unit and the combustion engine unit in a super charged engine. It is to be stated this early that the rotary machine has no crankshaft and that the power supplied to or taken out from the machine is effected directly to or from the rotor.

Prior art combustion engines of the rotary type are embodied as rotary piston engines. Here is the rotary piston rotating, which piston is in form of a rotor having an arched triangular design, in an annular cylinder bore. Such combustion engines have, in addition to a complicated design, that disadvantage that the rotor have considerably sealing problems against the cylinder wall. Moreover, these combustion engines have a vast filel consumption.

A prior art combustion engine comprising an engine housing having a working chamber, which receives a continuously rotatable rotor, and inlet and outlet for combustion gasses, is known from DE-3011399. The rotor is substantially cylindrical and rotates in an elliptically designed cavity, which comprises diametrically opposing combustion chambers defined by the surface of the rotor and the internal surface of the cavity. The rotor is designed with radially extending sliding slots, which receive and guide vane pistons that are able to slide radially outwardly and inwardly in the sliding slots. The vanes are articulated connected via a connecting rod with a crank pin, which is further a part of a journalled crankshaft. When the rotor is rotating, the piston vanes are moving radially outwardly and inwardly in the sliding slots due to the fixed support to said crank pin. Thus the one set of vanes will act in the one part of the cavity, i.e. the one combustion chamber, while the other set of vanes will act in the diametrically opposite chamber.

U.S. Pat. No. 4,451,219 reveals a rotary steam engine having two chambers and no valves. Also this engine has two sets of rotor blades with three blades in each set. Each set of rotor blades is turning around its own eccentric point on a stationary common crankshaft within an elliptical engine housing. A rotor of drum type is centrally mounted in the engine housing and defines two diametrically opposing radially working chambers. The two sets of rotor blades are moving substantially radially outwardly and inwardly in sliding slots in the rotor in accordance with the above described engine. The vanes are also here in their central end supported in an eccentric located shaft stub that is fixed. However, the vanes are not articulated, but are in the opposite end PivotTable journalled in a bearing provided peripheral in the rotor.

Pumps and compressors of the vane type are also known. U.S. Pat. No. 4,451,218 relates to a vane pump having rigid vanes and a rotor that is eccentric supported in the pump housing. The rotor has slots that the vanes pass radially through and are being guided by. On each side of the sliding slots are seals provided.

U.S. Pat. No. 4,385,873 shows a rotary engine of the vane type that can be used as motor, compressor or pump. This one also has an eccentric mounted rotor tho a number of rigid vanes are passing radially through.

Further examples of the prior art are disclosed in U.S. Pat. No. 4,767,295 and U.S. Pat. No. 5,135,372.

SUMMARY OF THE INVENTION

One object with the present invention is to provide a rotary-piston engine having a high efficiency, low fuel consumption and low emissions of polluting substances, like carbornonoxide, nitrous gasses and unburnt hydrocarbons.

Another object with the present invention is to provide a rotary-piston machine of a compact design, i.e. small machine displacement volume and small overall volume in respect of power output.

In accordance with the present invention, a rotary-piston machine of the type described in the introductory part of the specification is provided, and is distinguished by that each vane is articulated connected about an axis to one end of a control arm and is in the other end pivotally journalled in a fixed axle shaft having a central axis being coincident with the axis extending centrally through the cavity of the housing, which axis extend in parallel with and is spaced apart from the rotor axis, and the rotor proper constitute the unit for power take off or power input. The above disclosed embodiment is a clean rotary-piston machine that can be a compressor or a combustion engine with or without an external compressor.

Preferably do each vane tip describe a cylinder surface sector having centre of curvature in the axis through the joint connecting the vane to the control arm. The idea of this is that the tip of the vane, along a line extending in parallel with the rotor axis, at any time is to be tangent to the internal surface of the cavity, though not touch the surface. This line will be displaced on the vane tip during rotation of the rotor and will at any time describe a cylinder surface which is approximately similar to the internal surface of the housing with a difference in the tolerance that is present between the tip of the vane and the internal surface of the housing only. The tolerance between the vane tip and the internal surface of the cavity is to be as small as it is practical possible to make it.

As a particularly favourable embodiment, the arch length of the cylinder surface sector, and thus the thickness of each vane, is determined by geometric relations, i.e. radius for the cylinder surface sector, the distance between the central axis of the cavity and the axis through the joint that connects the vane to the control arm, and the distance between the rotor axis and the central axis of the cavity. When these geometric conditions are present, an optimum design is obtained causing that the vane tip at any time is tangent to the internal surface of the cavity during the complete revolution of the rotor, and this embodiment will be able to work well without use of sealings.

It is to be noted that the thickness of the vane can be larger without getting any effect for the sealing against the internal surface of the cavity. However, if the thickness of the vane is less than the optimum, a tangent of the tip of the vane against the internal surface of the cavity will not be obtained in parts of the revolution of the vane with the rotor and a sealing on the vane tip will normally be required. The thinner the vane is in respect of the optimum, the longer will the area that the vane tip is not tangent to the internal surface of the cavity be.

In some embodiments it may be suitable to provide sealing means between the tip of the vane and the internal surface of the housing. Preferably is the sealing means provided on the tip face of the vane and the sealing means is sweeping against the internal surface of the cavity. In some situations it may also be suitable to provide sealing means between the vane slots in the rotor and at least one side face of the vane. Sealing means can also be provided between the internal surface of the housing and the peripheral surface of the rotor where the surfaces are tangent to each other, alternatively in the area in which they intersect each other.

In order to minimise the wear of the vanes and improve the operating lifetime, sliding bearings can be provided in the slots in the rotor. The sliding bearings may be in form of exchangeable bearing inserts or be permanently provided to the rotor.

In one embodiment, the peripheral surface of the rotor can intersect into the internal surface of the housing across a sector and a corresponding recess is then formed in said surface of the engine housing.

In one embodiment the rotary-piston machine comprises at least one compressor unit which is co-rotating with the combustion engine unit and have a design corresponding to the combustion engine unit, i.e. have a separate cavity, a separate rotor and separate vanes, in addition to passages that connect the respective cavities.

With the object to stabilise the fixed axle shaft in the housing, the free end of the axle shaft can be supported internally in the rotor proper by means of a custom designed eccentric adapter and a bearing.

One exemplary embodiment of the rotary-piston machine according to the invention will now be described in closer detail with reference to the accompanying drawings where:

DETAIL DESCRIPTION OF THE DRAWINGS

Figure 1:
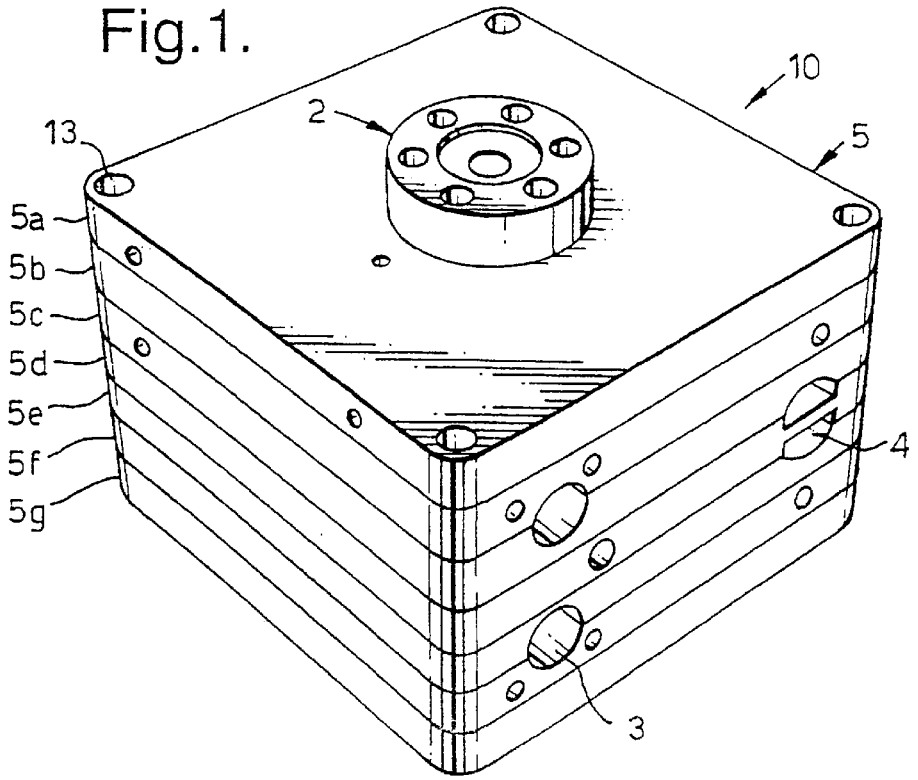
FIG. 1 shows a perspective view of one embodiment of a rotary-piston machine in form of a combustion engine and two adjacent compressors, one on each side of the combustion engine, and like it appears when in assembled state.

FIG. 1 shows one embodiment of a rotary-piston machine 10 according to the invention. However, it is to be noted that this is an embodiment of the machine that is assembled of a combustion engine unit and two compressor units, one on each side of the combustion engine unit, and in which all units are co-rotating. Further, it is to be noted that the engine is designed and manufactured with such precision that use of sealings are kept at a minimum. Use of labyrinth sealings is considered. Further tests will in time reveal this and presumably will at least some applications work well without sealings and without lubrications, except the bearings, which are sealed and prelubricated. The constructing materials can be different steel grades, but also plastics and teflon will be well suited for some applications.

The rotary-piston machine 10 represents in FIGS. 1–18 a supercharged combustion engine.

The engine 10 comprises a housing 5 having several internal cylindric surfaces which surround an eccentric located rotor 2 where the power output part of the rotor 2 is showing on the figure. Note that the engine is omit a crankshaft and the power is taken out directly from the rotor 2. The rotor 2 rotates about a rotation axis A. The housing 5 is constructed of a number of plates having similar thickness and external configuration. The housing 5 may instead be manufactured in two halves that are placed against each other. How the housing is being manufactured is, however, a choice that has to be taken of a man skilled in the art.

The rotary-piston engine 10 further comprises inlet passages 3 for fuel and air mixture and outlet passages 4 for exhaust gases. The individual parts of the housing 5 are kept together by means of bolts extending through holes 13 in each comer of the housing 5. The individual plates that the housing 5 is constructed of are numbered 5*a* to 5*g*. Thus the plate 5*a* represents the upper end cover and the plate 5*a* the lower end cover.

Figure 2:
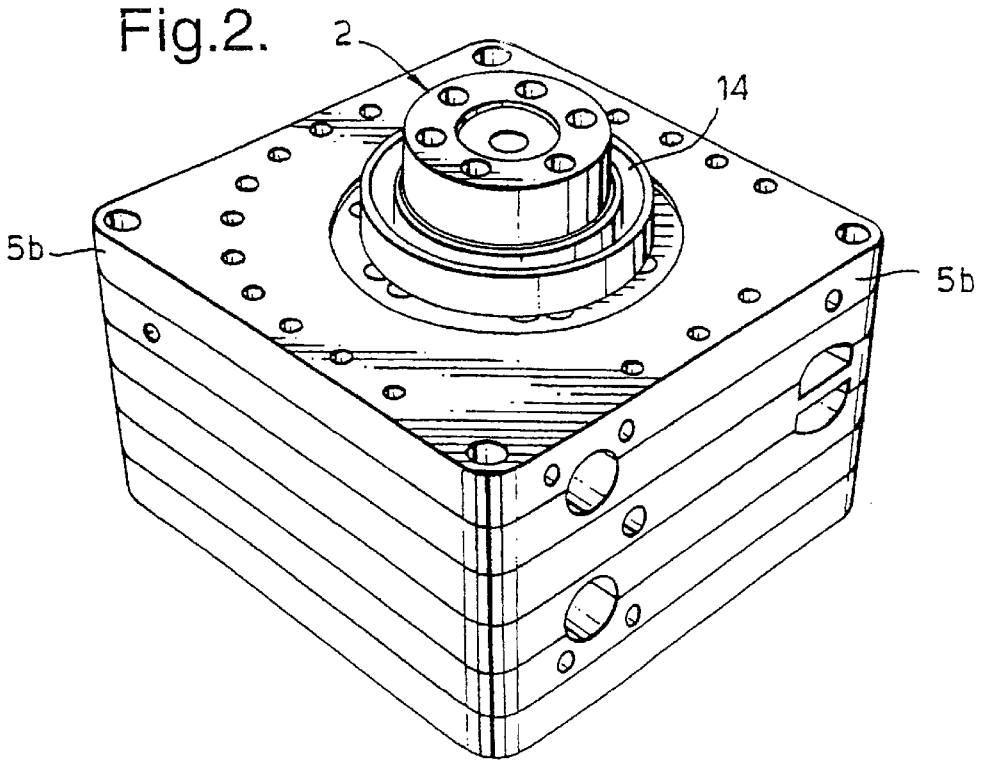
FIG. 2 shows the rotary-piston machine when one of the end covers is lifted off.

FIG. 2 shows the rotary-piston engine 10 according to FIG. 1, but where the upper end cover 5*a* is lifted off. By this an upper end bearing 14 appears. Internally of the end cover 5*a* is a circular aperture recessed for receipt of the bearing 14. The bearing 14 thus act as end support for the rotor 2.

Figure 3:
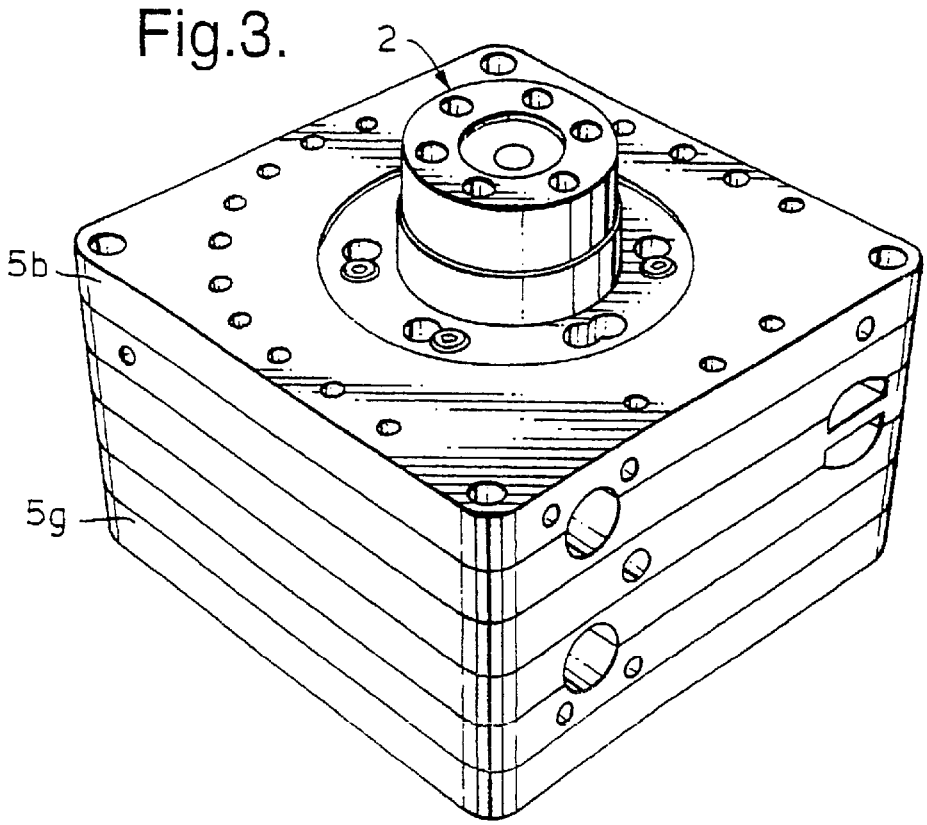
FIG. 3 shows the rotary-piston machine according to FIG. 2 when the end bearino is removed.

FIG. 3 shows the same as FIG. 2, except that the end bearing 14 is lifted off the end of the rotor 2. Thus more of the rotor 2 is appearing.

Figure 4:
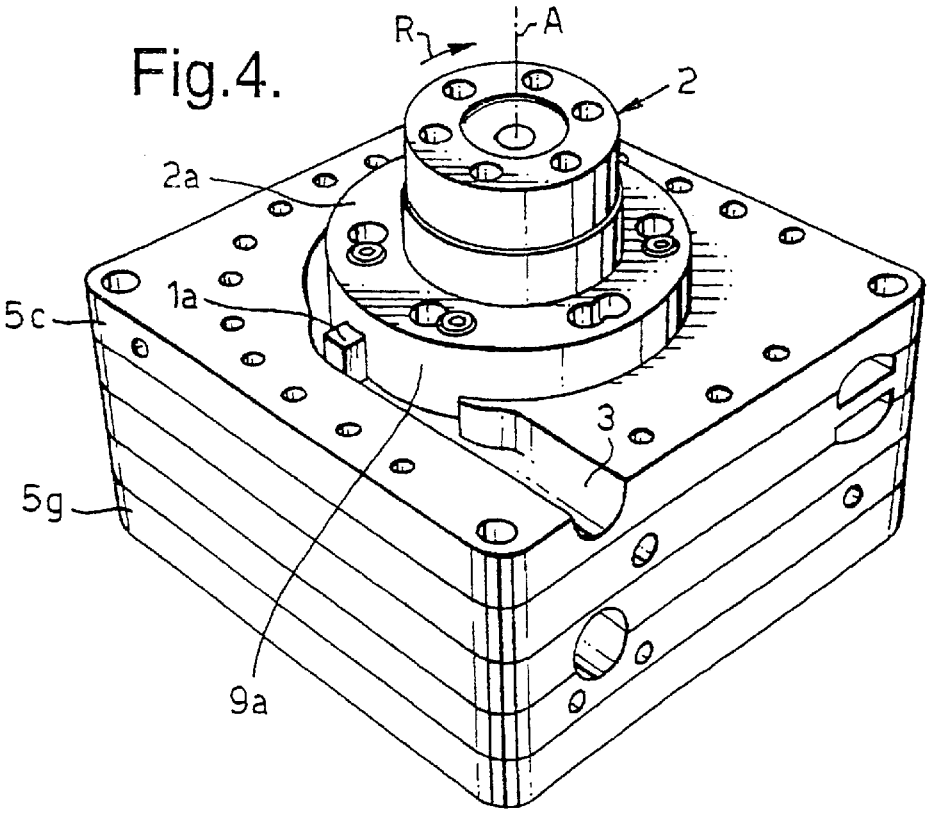
FIG. 4 shows the rotary-piston machine according to FIG. 3 when another part of the housing is lifted off and more of the rotor appears.

FIG. 4 shows the same as FIG. 3, but where another plate 5*b* of the housing 5 is lifted off. Thus more of the rotor 2 appears and shows a rotor vane 1*a*. Also the inlet passage 3 is shown. The inlet passage 3 leads from the external of the engine housing 5 to a chamber 9*a* within the housing 5. That part of the rotor 2 having the vanes 1*a* and the housing part 5*c* that is illustrated in FIG. 4, constitutes a first compressor unit that rotates around the axis A.

Figure 5:
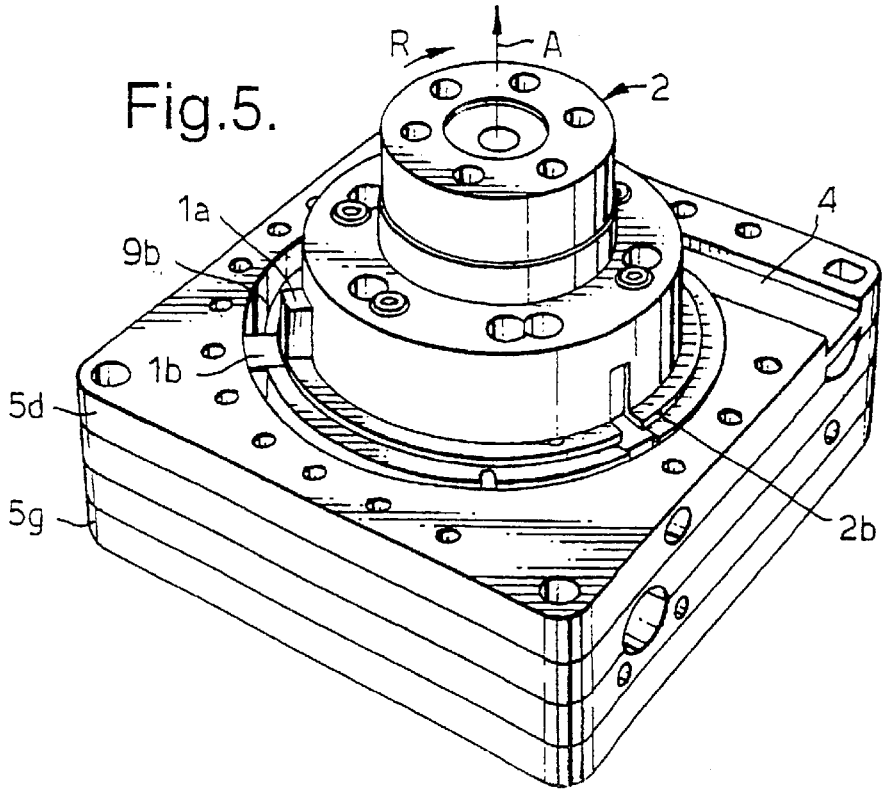
FIG. 5 shows the rotary-piston machine according to FIG. 4 when another part of the housing is lifted off and still more of the rotor appears.

In FIG. 5 is another part 5*c* of the housing 5 lifted off and further parts of the rotor 2 appear. Thus a rotor vane 1*b* is shown that runs in the chamber 9*b* and together with this part of the rotor 2 forms the combustion engine unit. From the chamber 9*b* in the combustion engine unit an outlet passage 4 is extending and leads to the environment.

Figure 6:
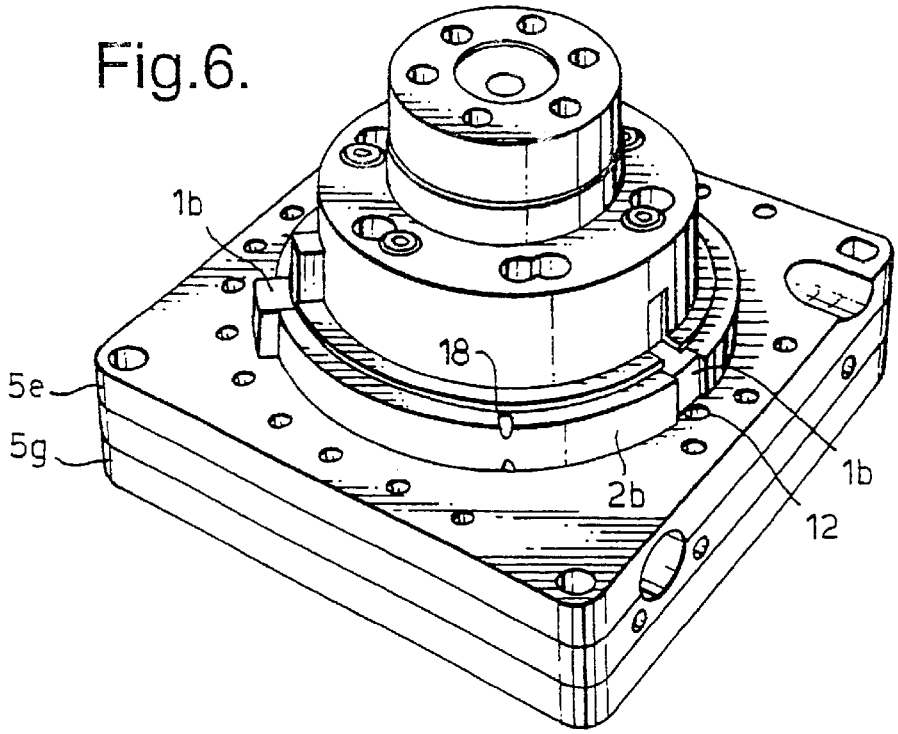
FIG. 6 shows the rotary-piston machine according to FIG. 5 when another part of the housing is lifted off and still more of the rotor appears.

In FIG. 6 is another plate part 5*d* of the housing 5 lifted off and more of the combustion engine unit appears.

Figure 7:
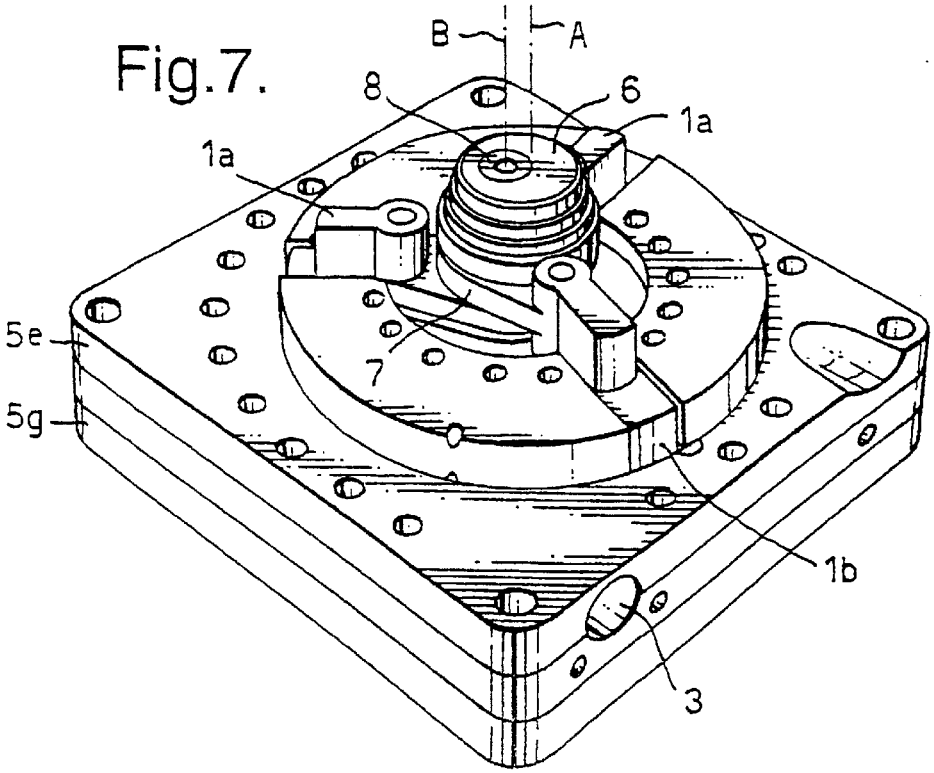
FIG. 7 shows the rotary-piston machine according to FIG. 6 in which one of the halves of the rotor housing is lifted off and the rotor vane unit clearly appears.

In FIG. 7 is the upper half 2*a* of the rotor 2 lifted off and the vane unit 1 with its respective vanes 1*a*,1*b* appears clearly. The vane unit 1 comprises in the shown embodiment three compressor vanes 1*a* and three combustion engine vanes 1*b*. Each vane 1*a*,1*b* is articulated connected to one end of a control arm 7 which is in the other end thereof pivotally supported in a stationary axle shaft 8 having a central axis B coincident with the longitudinal axis of the engine housing 5. This is shown in entirety in FIG. 8–12. The control arms 7 do not transmit any power, but provide for that each vane 1*a*,1*b*,1*c* are in forced motion to slide radially inwardly and outwardly in guide slots 11 in the rotor 2 so that the vane tips at any time during the rotation of the rotor 2 are tangent to the internal surfaces of the housing. The reference number 6 denotes an eccentric adapter which is further described later with reference to FIG. 22. The other compressor unit is lying under the combustion engine unit and is completely corresponding to the upper compressor unit.

Figure 8:
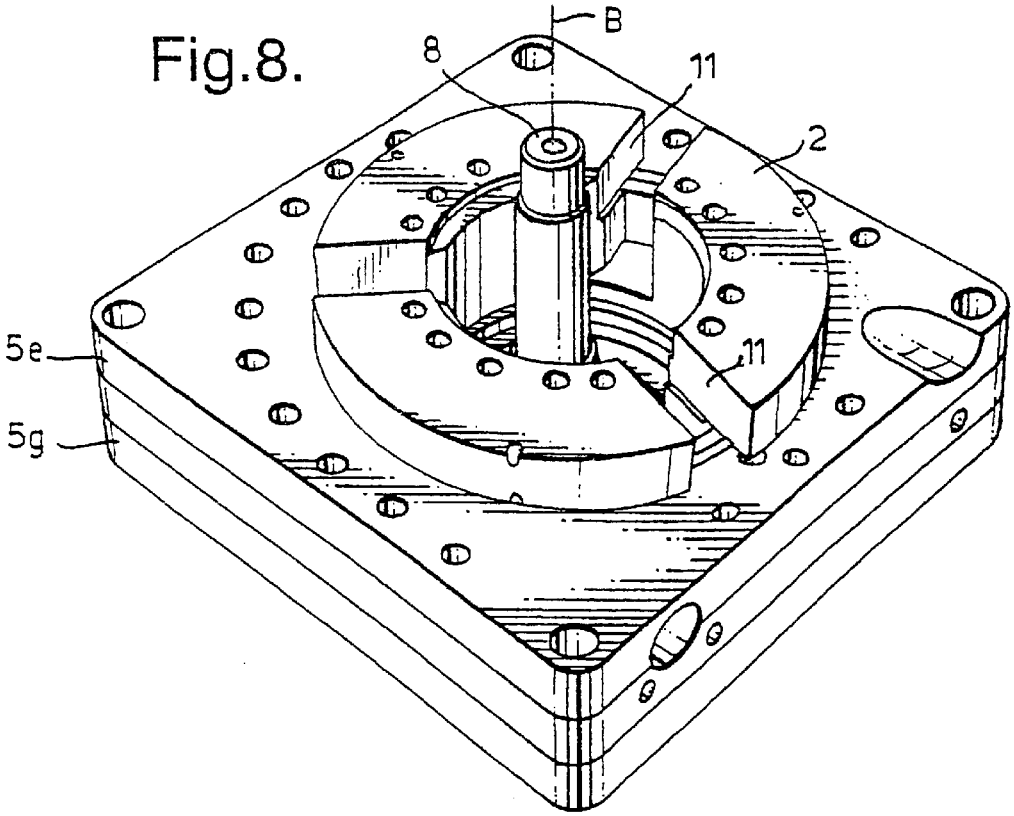
FIG. 8 shows the rotary-piston machine according to FIG. 7 in which also the rotor vane unit is lifted off so that the second half of the rotor housing remain in the housing in is addition to the axle shaft provided eccentric in the housing.

In FIG. 8 is the lower part 2*b* of the rotor 2 shown after the vane unit 1 is lifted off. In this figure the radially extending slots 11, which the respective vanes 1*a*, 1*b*, 1*c* are running in, are clearly shown. As mentioned, the axle shaft 8 is centrally extending in the cavity 9 of the housing 5. The axis A of the rotor 2 extends in parallel with the central axis B of the housing 5, but is extending eccentric in respect of the axis B of the housing 5. This eccentricity is illustrated in FIG. 7 where both axis A and B are shown. By means of this eccentricity the radial movement is obtained, or the forced movement of the respective vanes 1*a*,1*b*,1*c* inwardly and outwardly in the respective guiding slots 11 in the rotor 2.

Figure 9:
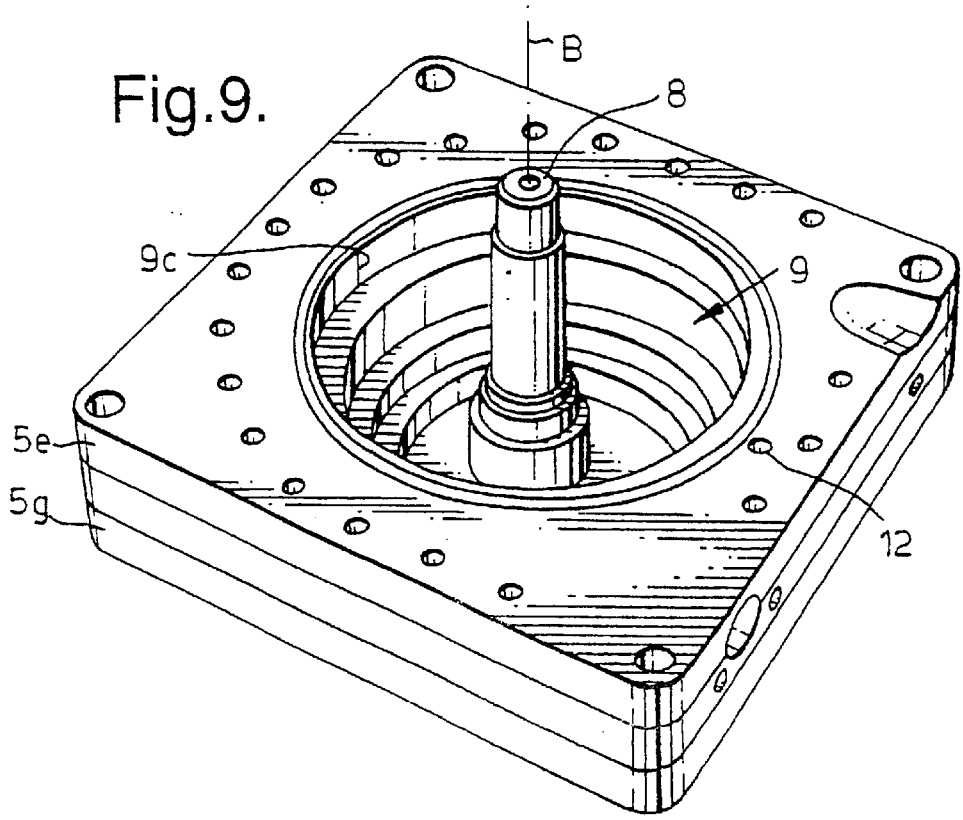
FIG. 9 shows the rotary-piston machine according to FIG. 8, in which the last part of the rotor is removed.

FIG. 9 shows the cavity 9 in the engine housing 5 after that also the lower part 2*b* of the rotor 2 is lifted out.

Figure 10:
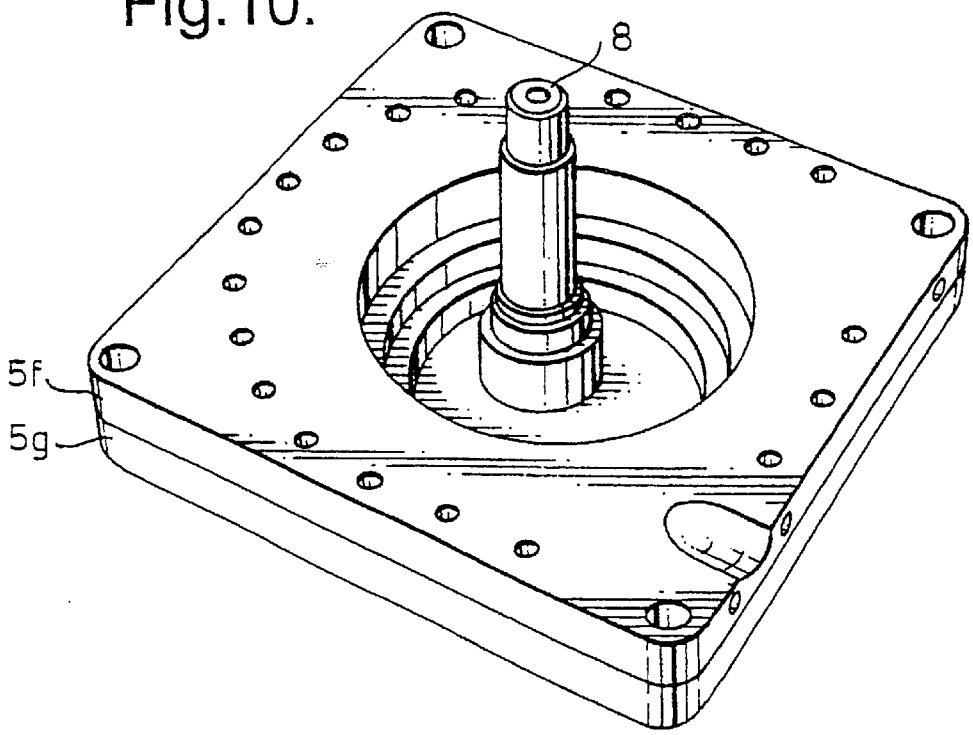
FIG. 10 shows the rotary-piston machine when another part of the housing is lifted off.

In FIG. 10 is still another plate part 5*e* of the housing lifted off.

Figure 11:
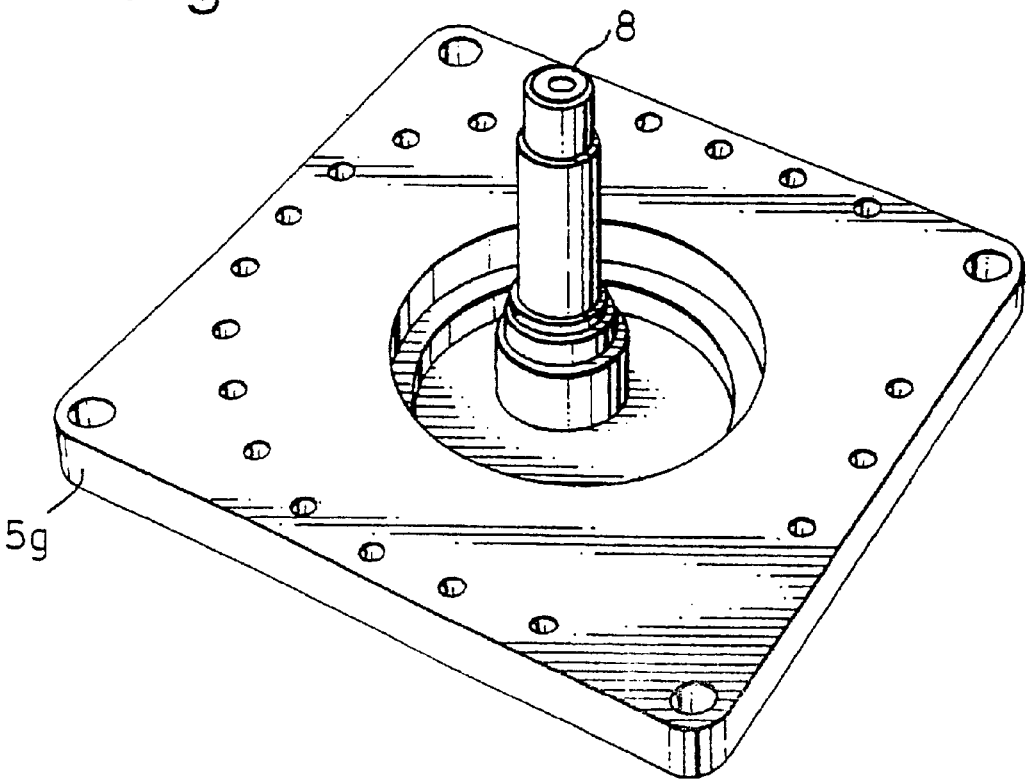
FIG. 11 shows the rotary-piston machine when another part of the housing is lifted off so that only the second end cover do remain together with the eccentric axle shaft.

FIG. 11 shows the final end cover 5*g* after the plate part 5*f* is lifted off.

Figure 12:
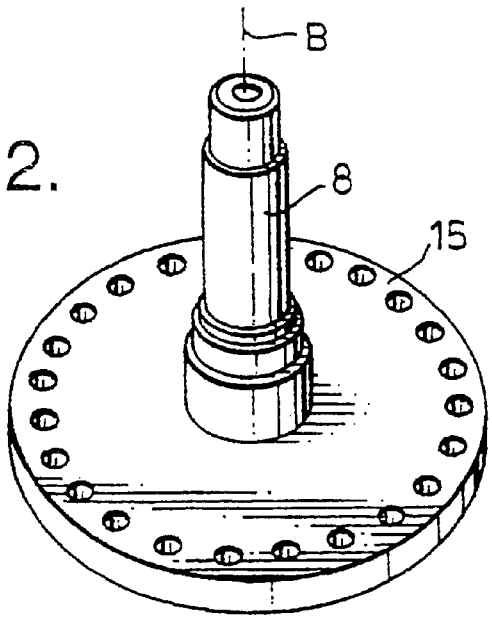
FIG. 12 shows the eccentric axle shaft.

FIG. 12 shows the stationary axle shaft 8 fixed to a stationary end flange 15.

Figure 13:
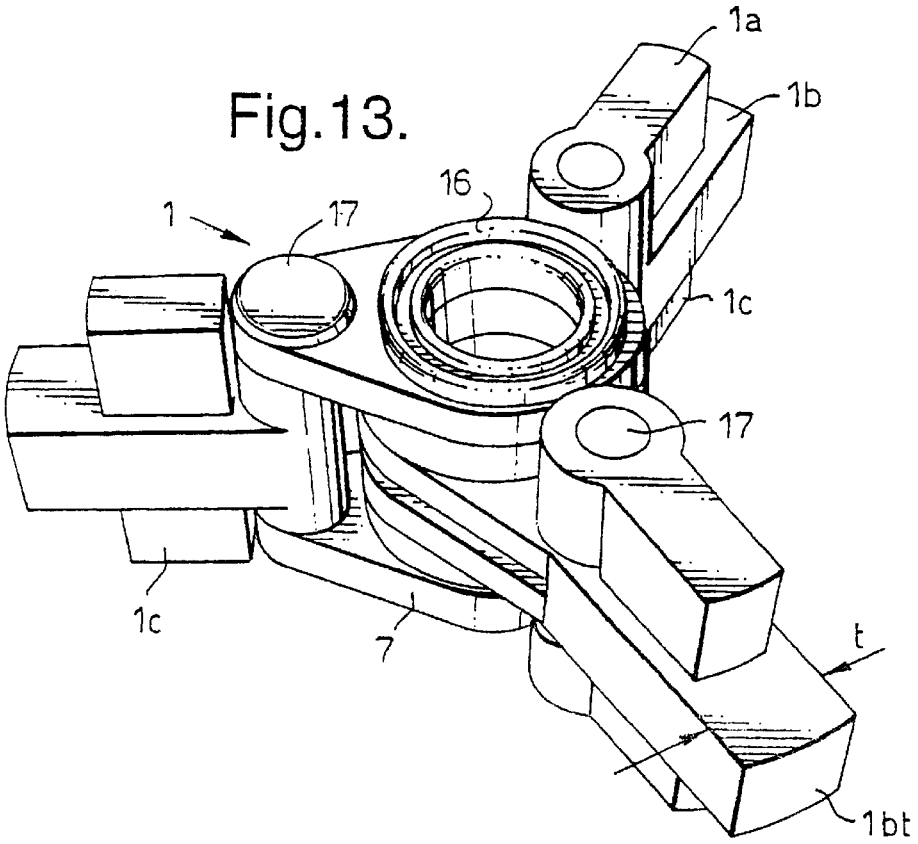
FIG. 13 shows the assembled rotor vane unit including three vane parts.
Figure 14:
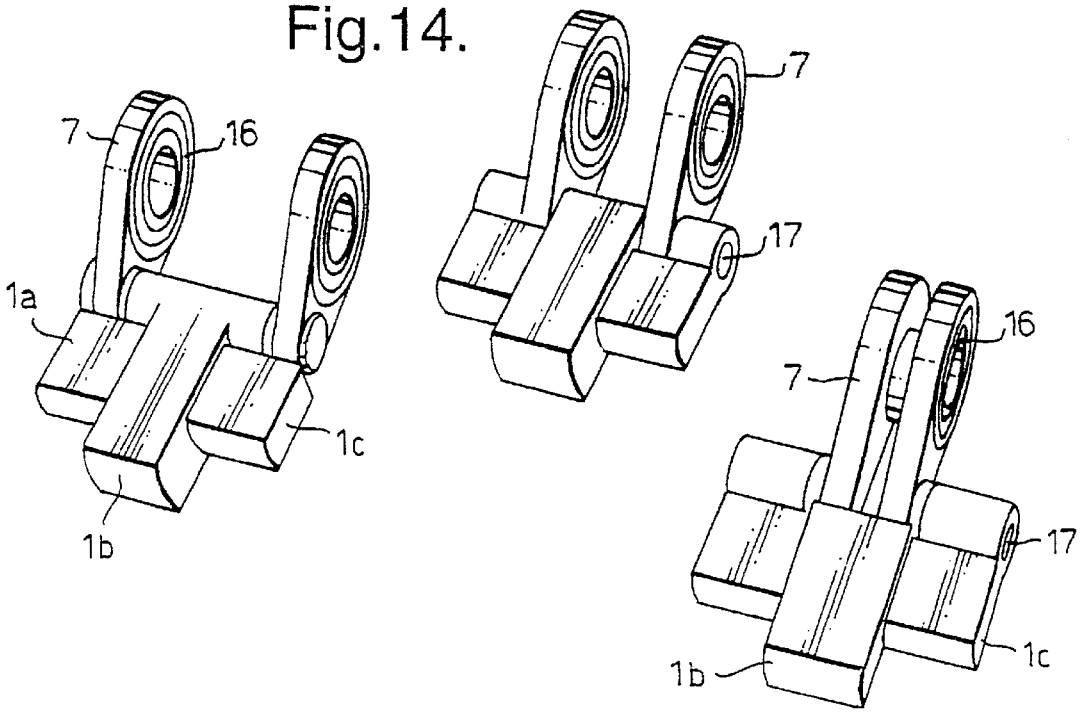
FIG. 14 shows the unit according to FIG. 13 disassembled and the individual parts so deployed.

FIG. 13 shows the vane unit 1 as assembled when it is to be put on the stationary axle shaft 8. As mentioned, the vane unit 1 consists of a combustion engine vane 1*b* and two compressor engine vanes 1*a* and 1*c* located on each side of the combustion engine vane 1*b*. Each set of vanes 1*a*,1*b*,1*c* is articulated connected to respective control arms 7. When the vane unit 1 consists of three set of vanes, it is found to be convenient to arrange the respective control arms 7 with different mutual distance for each set of vanes 1*a*,1*b*,1*c* as shown in FIG. 14. Each control arm 7 includes a bearing 16 that enables the set of vanes 1*a*,1*b*,1*c* and each control arm 7 to rotate around the stationary axle shaft 8. Further, each set of vanes consists of an articulated connection in form of an axle pin 17, having rotational axis C, that is provided between the set of vanes 1*a*,1*b*,1*c* and two control arms 7.

It is further to be understood that in a presently considered optimal embodiment of the engine, there is a certain relation between the thickness t of each vane, the distance between the axis C and the axis B and the eccentricity of the rotor 2 in respect of the housing 5, i.e. the distance between the axis A and B. This is necessary in order that the vane tips 1*bt* are to follow, with predetermined distance and minimum clearance, the internal surface 20 of the housing 5. Further, the surface of the vane tips 1*bt* have to be arcuate such that the surface continuously follows or is tangent to the internal surface 20 of the housing 5 with small clearance. The point of tangent is, however, displaced along the arcuate surface of the vane tip 1*bt* and is performing like a rocking movement on the internal surface 20. In order to get this to correspond, do the surface of the vane tips 1*bt* have a centre of curvature in the axis C that links the vane 1*b* to the control arm 7. This is easier understood by studying FIGS. 19–21. The same relation as the above described is also true for the compressor vanes 1*a* and 1*c* having their own thickness, separate distances and curvature of the vane tips.

The surfaces of the vane tips might be provided with a suitable sealing means for engaging the internal surface 20 of the housing 5. It is, however, most preferred that no contact occur between these surfaces and thus can a suitable solution comprise labyrinth sealings on the surface of the vane tips in necessary extent and design.

Figure 15:
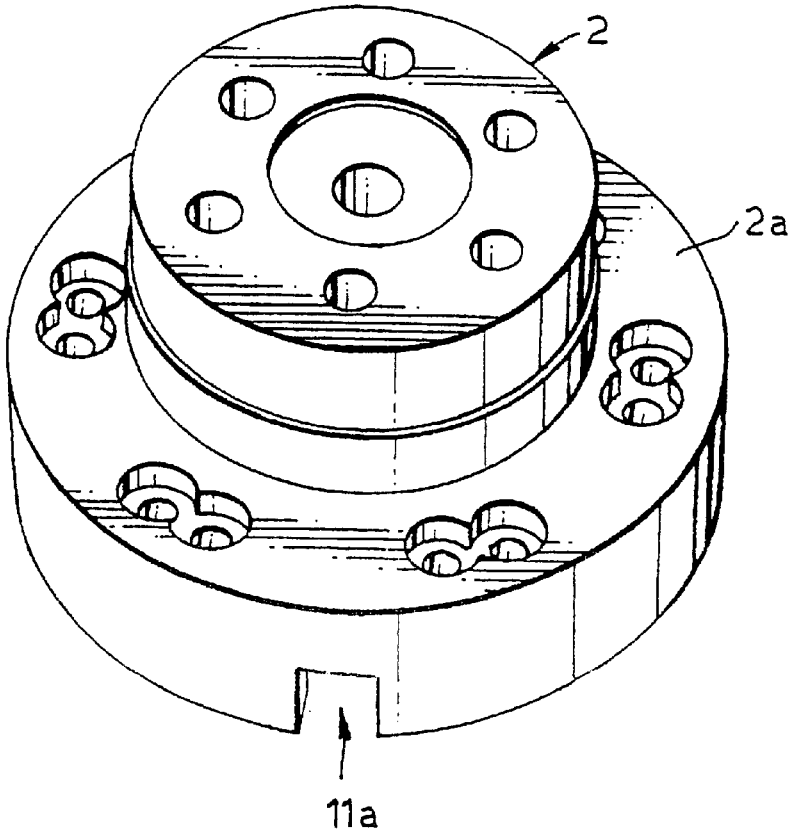
FIG. 15 shows the one half of the rotor housing viewed externally.
Figure 16:
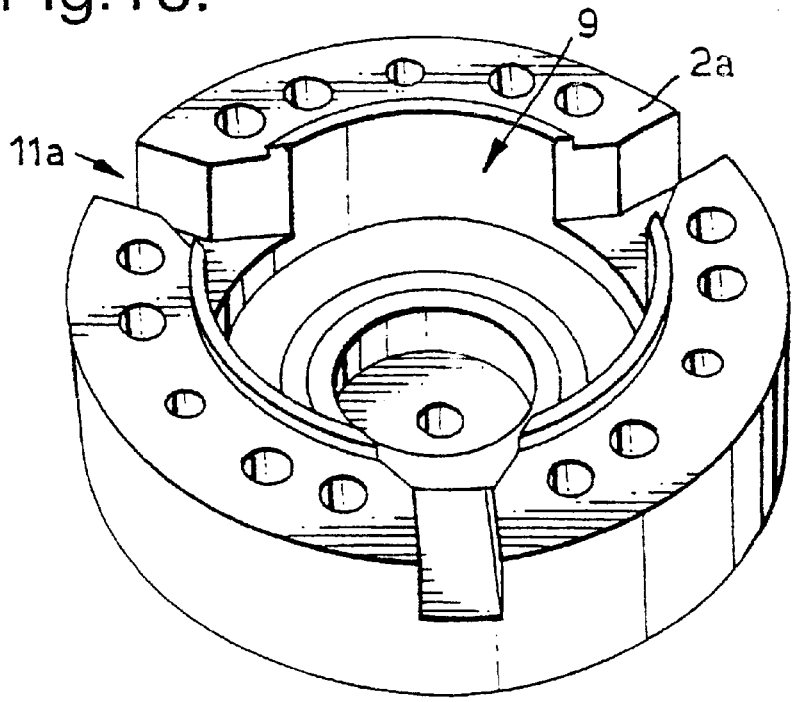
FIG. 16 shows the same rotor housing half as in FIG. 15, but viewed internally.

FIG. 15 shows the upper part 2*a* of the rotor 2 and which constitute the hub for power output, while FIG. 16 shows the same part inverted so that the internal cavity and the guiding slots 11*a* that the upper compressor vanes 1*a* are sliding radially in and out of, can be seen.

Figure 17:
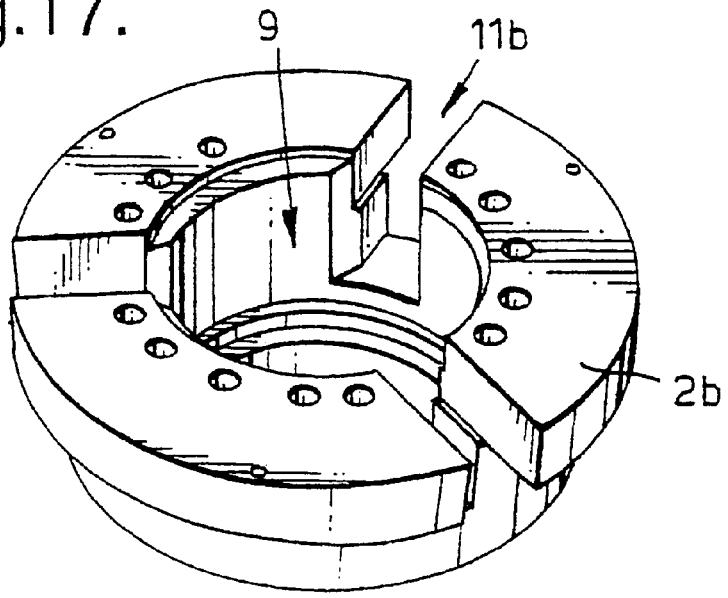
FIG. 17 shows the lower half of the rotor housing viewed internally.
Figure 18:
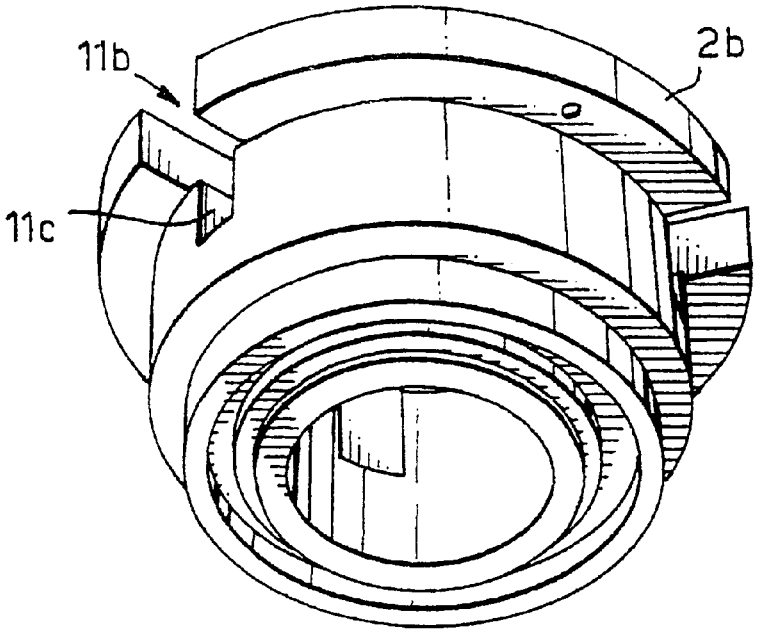
FIG. 18 shows the lower half of the rotor housing viewed extemally.

FIG. 17 shows the lower part 2*b* of the rotor housing 2 viewed internally and FIG. 18 shows the same part viewed externally and with the respective sliding slots 1*b* for the combustion engine vanes 1*b* and sliding slots 1*c* for the vanes 1*c* on the lower compressor unit.

The operation of the engine will now be described and is given with reference to FIGS. 4–6. As indicated earlier, the illustrated embodiment of the invention shows a combustion engine having a compressor unit on each side. The rotor 2 will be rotating about its centre axis A in the direction that the arrow R indicates in FIG. 4. When the rotor 2 rotates, the compressor vanes 1*a*, which are running in the compressor chamber 9*b*, draws an air/fuel mixture through the passage 3 and into the chamber 9*b*. The suction period starts when the vane 1*a* is passing the inlet of passage 3 leading into the chamber 9*b* and lasts till the next vane passes the same inlet. That side of the compressor vane 1*a*, which faces opposite of the sense of rotation, constitutes the suction side of the compressor, while that side which faces in the sense of rotation constitute the pressure side. This implies that when the compressor vanes 1*a* pass the inlet of passages 3 to the chamber 9*a*, the pressure side of the compressor vane 1*a* commences its compression work, while the opposite side commences its suction work. Because the chamber 9*a* taper in that the internal surface 20 of the housing converge toward the peripheral surface 21 of the rotor, a compressing operation is achieved in known manner when the vanes 1*a* are displaced in the chamber 9*a*.

Further, passages are provided between the compressor chamber 9*a* and the combustion chamber 9*b* in the combustion engine unit located adjacent to the compressor unit in the next "layer", as disclosed in FIGS. 5 and 6. Each passage extend from the most narrow part of the compressor chamber 9*a* and opens into the combustion chamber 9*b* where the chamber starts to widen out and forms together with the vanes 9*b* an expansion chamber. The passage or passages can be located at suitable places, like in the body of the engine housing 5 or in the rotor with the rotor vanes 1*a*,1*b* acting as valves for letting in the fuel mixture at correct moment. In FIG. 6 is the outlet of the passage from the lower compression chamber 9*c* into the combustion chamber 9*b* denoted by the reference number 12. A corresponding outlet is provided through the housing 5 from the upper compression chamber 9*a*, but that is not shown in the drawings. The outlets do, however, communicate with smaller recesses 18 in the rotor 2 for instantaneous transfer of pressure from the compression chamber 9*a* to the combustion chamber 9*b*. Thus the outlets 12 and the recesses act like valves in respect of each other.

The fuel mixture is ignited approximately in the area in which the recess 18 is in FIG. 6 and occurs when the vane 1*b* is approaching this place. When the rotor 2 and the vanes 1*b* have passed through a certain circle arch corresponding to the expansion phase, the passage 4 for exhaust is exposed and the exhaust is released to the environment.

As it is to be understood, the air-fuel mixture is supplied to the combustion engine unit from both sides, i.e. from both the upper and lower compressor unit. In further embodiments, there might be one compressor unit only, an externally compressor unit or be completely omitted. The number of sets of vanes may vary in accordance with what is considered to be suitable for the respective application.

Figure 19:
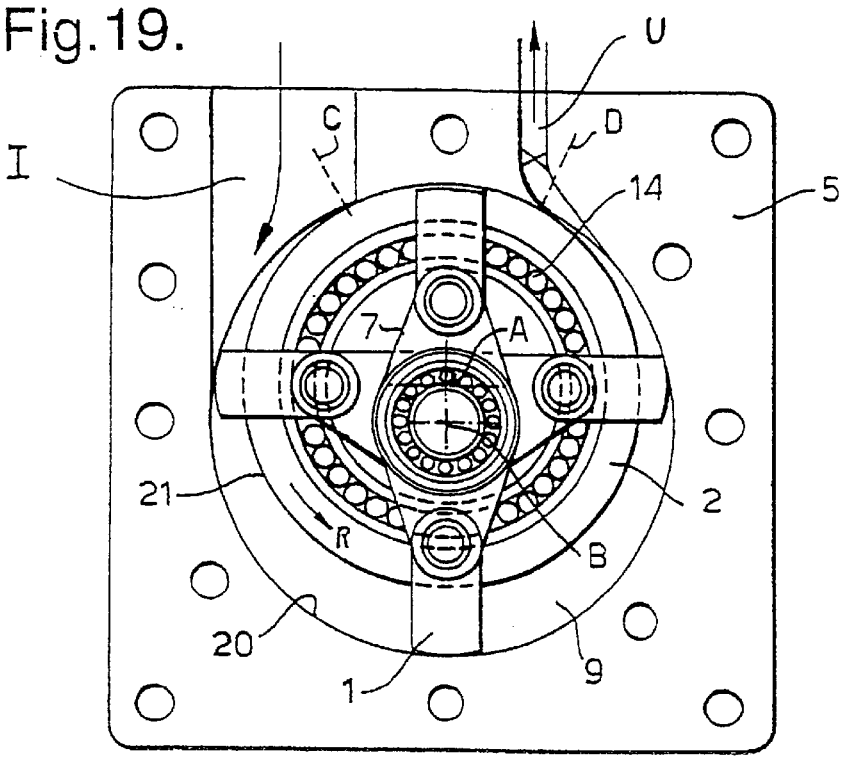
FIG. 19 shows a principle view of a second embodiment of a rotary-piston machine in form of a compressor, or pump, having four vanes according to the invention.

FIG. 19 shows a four vane compressor embodiment of the present invention. Like in the embodiment just described, this includes a schematically illustrated housing 5, a rotor 2, but four vanes 1 that are moving radially outwardly and inwardly in sliding slots 11 recessed in the rotor 2. The housing 5 has a cavity 9 having centre in the axis B and an internal surface 20 which the end surfaces of the vanes 1 nearly touch.

The rotor 2 has an external peripheral surface 21 and rotates about the rotor axis A. Between the position C and D is the internal surface 20 of the housing 5 described by a cylinder surface sector corresponding substantially to a sector of the peripheral surface 21 of the rotor 2. Thus the complete internal surface of the housing can be described as if it was formed of two incomplete cylinder surfaces, or cylinder surface sectors, not having coinciding centre axis and where the smaller cylinder surface cuts into the larger cylinder surface across a predetermined cylinder sector.

That location (C and D) where the two cylinder surfaces intersect, a type of valves are formed that effectively stop back flow of gases. Optionally, labyrinth sealings can be provided in the housing 5 in the area at C and D, possibly in the entire area between C and D. The distance between C and D can be varied or optimised for the respective application of the machine. When the distance between C and D is zero, the internal surface of the housing 5 will be cylindrical and the peripheral surface 21 of the rotor 2 will be tangent to the internal surface 20 along a line at the location C,D.

When the rotor 2 rotates in the direction of the arrow R, air is sucked in through the inlet passage I. The next following vane 1 carries the drawn air with and commence compression work when the vane 1 is passing its lowermost position (six o'clock in FIG. 19). The air is compressed against the outlet passage U by the further movement of the vane 1 towards the uppermost position (twelve o'clock in FIG. 19).

Figure 20:
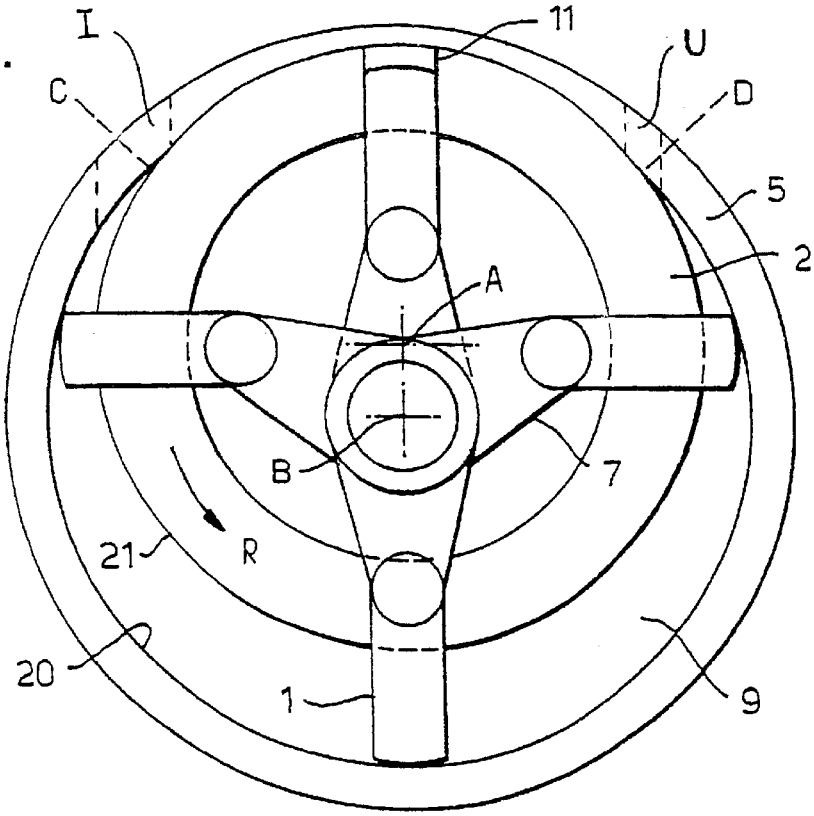
FIG. 20 shows another embodiment of the rotary-piston machine having four vanes in which the peripheral surface of the rotor across a sector cuts into the internal surface of the housing, according to the invention.

FIG. 20 shows a simple four vane rotary machine, here in form of a pure pump or compressor. The machine is much similar to the compressor described above with reference to FIG. 19. However, just the eccentricity and those circles (cylinder surfaces) which intersect each other appear more clearly. The rotor 2 moves in the direction of the arrow R. Air is sucked in through the inlet passage I. The air is drawn and entailed by the vanes and is displaced out again through the outlet U.

Figure 21:
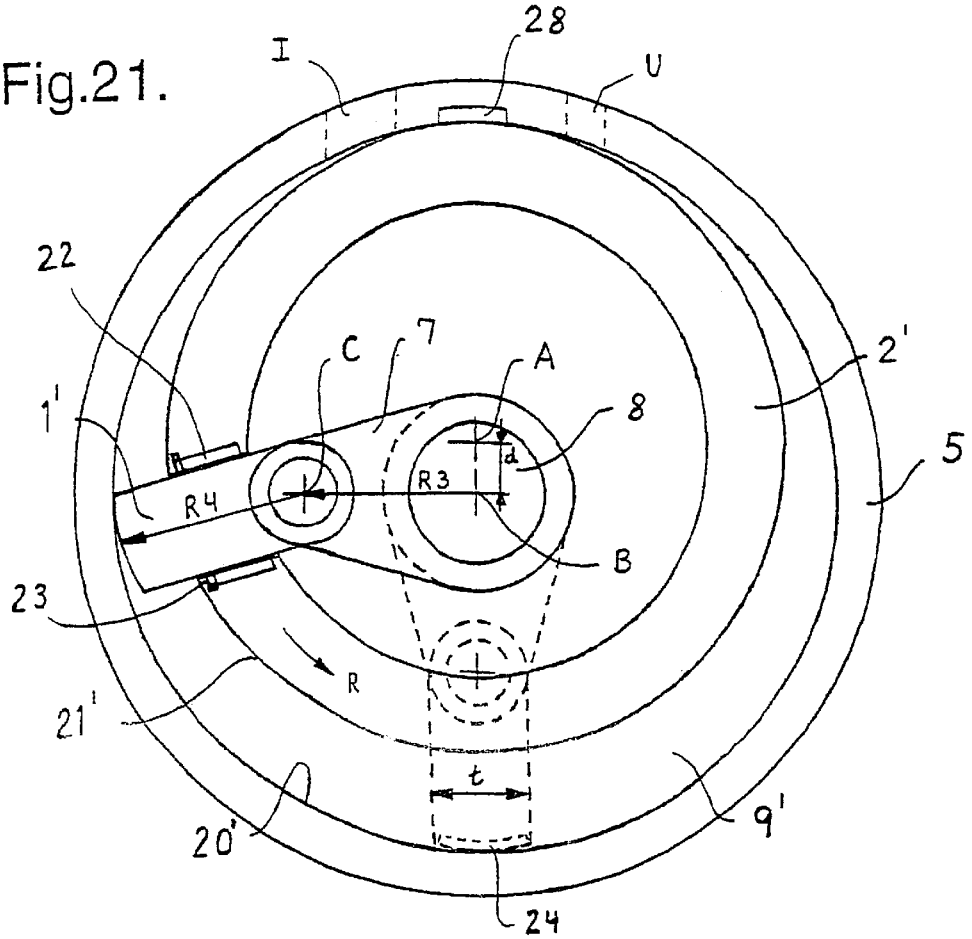
FIG. 21 shows a principle view of still another embodiment of the rotary-piston machine having one vane only, according to the invention.

FIG. 21 shows a one vane rotary machine, here in form of a pump, or compressor unit where also optional sealing means 23 and bearings 22 are illustrated. The sealing means can be pure scraping seals or labyrinth seals. The bearing 22 can be an insert of suitable bearing material, like babbit metal or bronze, possibly teflon for some applications. The tip of the vane can also be provided with a seal 24 that contacts or drag against the internal surface 20' of the housing. Between the inlet 1 and the outlet U is advantageously a sealing 28 provided, preferably a labyrinth sealing.

A one vane rotary machine needs counter weights (not shown) in order to balance mass forces. This FIG. 21 illustrates in particular the geometric relations that apply for an optimal machine. An optimal machine is defined as a machine having a minimum of necessary dragging or engaging seals and preferably totally omit contacting seals. Non-contacting seals, like labyrinth seals, are however acceptable.

Each vane tip describes a cylinder surface sector having a particular arch length and curvature, which are determined on basis of geometric relations. The radius of curvature R4 of the vane tip is determined by the distance from the axis C to the internal surface 20' of the housing 5. The thickness t of the vane, and thus the arch length of the cylinder surface, is determined by the distance between the centre axis B and the axis C. accordingly the pivot radius R3 for the axis C, and the distance d between the rotor axis A and the centre axis B.

As it appears from the figure, see also the dotted vane in straight down position, the tip of the vane do perform a "rolling or rocking movement" against the internal surface 20' of the housing 5 during its revolution with the rotor 2. By half a revolution of the rotor 2, the vane tip has performed a rolling movement between the extreme edges of the arch. Thus the vane tip is rocking back and forth once during one revolution of the rotor. The vane thickness t may per se be thicker than the optimum without being of serious significance. If it is thinner, however, the tip of the vane will no longer at all times be tangent to the internal surface 20' during a revolution of the rotor and accordingly provide distance and gap between the surface 20' and the vane tip.

Figure 22:
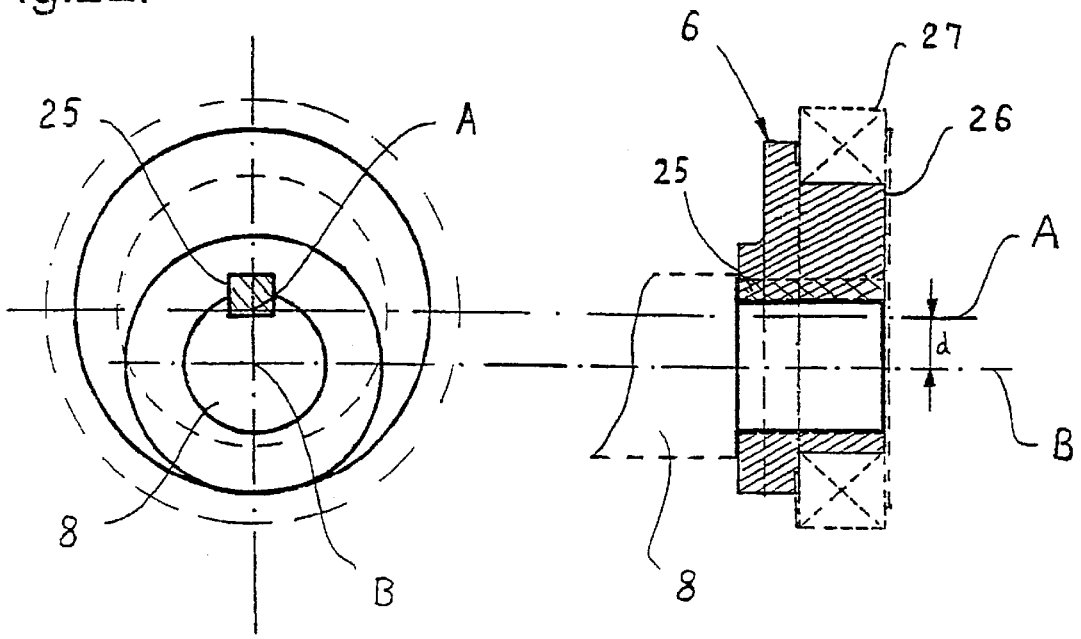
FIG. 22 shows the eccentric adapter that supports the rotor eccentric in respect of the cavity of the housing.

FIG. 22 shows in more detail the eccentric adapter 6. The eccentric adapter 6 is non rotatable fixed to the axle shaft 8 via a key 25. The adapter 6 have an eccentric, in respect of the centre axis B, and cylindric bearing pin 26 which supports a bearing 27 that is eccentric located in respect of the centre axis B, but is centric located in respect of the rotor axis A. The bearing 27 is stabilising the axle shaft 8 in the free end thereof, in addition to provide internal support to the upper rotor part 2*a*. The bearing is accordingly concentric located in respect of the upper, external bearing 14 and a corresponding bearing (not shown) in the opposite end of the rotor 2, i.e. supports the rotor part 2*b*. This eccentricity provides the forced movement of the vanes 1 via the control arms 7.

What is claimed is:

1. A rotary-piston machine (10) comprising a housing (5) having a cavity (9). a rotor (2) received in the housing (5), which rotor (2) has a rotor axis (A) and a peripheral surface (21). inlet and outlet passages (3,4) in communication with said cavity (9), one or more vanes (1) that are radially slideable received in slots (11) in the rotor (2), each vane (1) extending radially from the internal surface (20) of the housing (5) to the rotor axis (A), at least one working chamber (9*a*) being part of the cavity (9) and defined by the internal surface (20) of the housing (5), the peripheral surface (21) of the rotor (2) and the side surface of at least one vane (1), each vane (1) being articulated connected about aa axis (C) to one end of a control arm (7) and in the other end thereof bein, pivotally supported in a fixed axle shaft (8) having a central axis (B) being coincident with the axis extending centrally through the cavity (9) of the housing (5), which axis (B) extend in parallel with and spaced apart (d) from the rotor axis (A), and the rotor (2) proper constitute the unit for power take off or power input, characterised in that each vane tip (1 *bt*) describes a cylinder surface sector having centre of curvature in the axis (C) extending through the joint that connects the vane (1) to the control arm (7).

2. A rotary-piston machine (10) according to claim 1, characterised in that the arch length of the cylinder surface sector, and thus the thickness (t) of each vane, is determined of geometric relations, i.e. the radius of curvature R4) for the cylinder surface sector, the distance (R3) between the centre axis (B) of the cavity and the axis (C) and the distance (d) between the rotor axis (A) and the centre axis (B).

3. A rotary-piston machine (10) according to claim 1, characterised in that sealing means is provided between the vane tip and the internal surface (20) of the housing (5).

4. A rotary-piston machine (10) according to claim 1, characterised in that sealing means are provided between the vane slots (11) and at least one of the side surfaces of the vanes (1).

5. A rotary-piston machine (10) according to claim 1, characterised in that sealing means are provided between the internal surface (20) of the housing (5) and the peripheral surface (21) of the rotor (2) where the surfaces are tangent to each other.

6. A rotary-piston machine (10) according to claim 1, characterised in that the vane slots (11) comprises sliding bearings that coact with the vane (1).

7. A rotary-piston machine (10) according to claim 1, characterised in that the peripheral surface (21) of the rotor (2) across a sector (C–D) do intersect into the internal surface (20) of the housing (5) and a corresponding recess is formed in the internal surface (20) of the machine housing (5) (FIG. 19A).

8. A rotary-piston machine (10) according to claim 1, characterised in that the machine comprises at least one compressor unit that is co-rotating with and is corresponding to the combustion engine unit and has a separate chamber (9*a*), a separate rotor and separate vanes (1*a*), and passages (12) that connect the respective cavities (9*a*,9*b*,9*c*).

9. A rotary-piston machine (10) according to claim 1, characterised in that the fixed axle shaft (8) is supported and stabilised in the free end thereof by the rotor (2) by means of an eccentric adapter (6).

* * * * *